United States Patent [19]

Sidney

[11] 4,060,148

[45] Nov. 29, 1977

[54] PORTABLE COLLAPSIBLE SCAFFOLD STRUCTURE

[76] Inventor: James T. Sidney, 1105 Wentworth Ave., Chicago Heights, Ill. 60411

[21] Appl. No.: 753,928

[22] Filed: Dec. 23, 1976

[51] Int. Cl.[2] ..... B66F 11/04

[52] U.S. Cl. ..... 182/2; 182/117; 182/127

[58] Field of Search ..... 182/2, 127, 117, 64–68, 182/63

[56] References Cited

U.S. PATENT DOCUMENTS

| | | | |
|---|---|---|---|
| 578,848 | 3/1897 | Woods | 182/127 |
| 2,787,278 | 4/1957 | Mitchell | 182/2 |
| 3,340,960 | 9/1967 | Wilson | 182/117 |
| 3,529,694 | 9/1970 | Atchey | 182/2 |
| 3,826,334 | 7/1974 | Spillman | 182/2 |

*Primary Examiner*—Reinaldo P. Machado
*Attorney, Agent, or Firm*—Ronald A. Sandler

[57] ABSTRACT

A portable collapsible scaffold structure is adapted to be supported in use upon and transported by a truck or other self-powered ground vehicle, and includes a pair of extensible ladders adapted to be mounted in use adjacent to the vehicle and coupled thereto by extensible support means for raising and lowering the ladders simultaneously, the ladders supporting between their upper ends a work platform. Extensible support posts support the ladders intermediate the ends thereof and are coupled to extensible carriage means which support the lower ends of the ladders for movement along the ground or other support surface during raising and lowering of the ladders. The entire structure is hydraulically operated and control means coupled to the ladders and the platform maintain the platform substantially horizontal during raising and lowering of the ladders. The entire scaffold structure can be readily disassembled and stored on the associated vehicle for transportation thereby.

20 Claims, 7 Drawing Figures

PORTABLE COLLAPSIBLE SCAFFOLD STRUCTURE

BACKGROUND OF THE INVENTION

The present invention relates to portable collapsible scaffold structure, and particularly to such structure which is adapted to be supported in use upon and transported by a self-powered ground vehicle.

Vehicle-mounted extensible elevated work platforms are known in the prior art. One such prior art apparatus comprises a truck supporting thereon a swivel-mounted extensible turret arm, carrying at the distal end thereof a work platform in the form of a bucket, generally suitable for supporting one, or at most two workmen. These systems are highly maneuverable and generally are provided with controls at the bucket so that the supported workman can control his position, but the apparatus is designed for supporting at most two workmen in a very confined work space, which affords little room for equipment used by the workmen. While the apparatus is useful for work at a fixed point or location such as in telephone pole or sign repair work or in rescue work, it is unsuitable for carpentry, roofing, painting, brickwork or the like, where the workman must work along an extended work area, since the entire turret must be continually moved as the workman changes his position along the work area.

Collapsible vehicle-mounted scaffold structure is also known in the prior art, being disclosed, for example, in the U.S. Pat. No. 2,778,694 issued to M. E. Mitchell on Jan. 27, 1957 and U.S. Pat. No. 3,472,337, issued to G. L. Atchey on Oct. 14, 1969. In both of these prior art equipments, the scaffolding is supported in use directly above the vehicle and, therefore, the apparatus is limited to those applications wherein the vehicle can be driven underneath the work area. The Mitchell and Atchey devices could not be utilized for work along the outer wall of the building because the scaffold platform could not be positioned in use against the wall.

SUMMARY OF THE INVENTION

The present invention provides a portable collapsible scaffold structure providing an elongated work platform suitable for supporting several workmen and/or a considerable amount of work equipment, and affording ease of movement of the workmen along an extended work site.

It is an important feature of the present invention that the collapsible scaffold structure is supported in use and transported by a ground vehicle, but is not limited in use to work positions overlying the vehicle.

More particularly, it is a feature of the present invention that there is provided a portable collapsible scaffold structure which is disposed in use on the ground adjacent to the vehicle and is coupled to the vehicle by driven support means for controlling the elevation of the scaffold work platform.

It is another feature of this invention to provide a portable collapsible scaffold structure which includes a scaffold platform supported by a pair of spaced-apart extensible boom members mounted in use on the ground, the boom members providing access to the platform and being coupled to the associated vehicle by driven extensible support means for varying the position and inclination of the boom members.

It is another feature of this invention that there is provided control means for maintaining the work platform substantially horizontal as the position and inclination of the boom members is varied.

The foregoing features are obtained, and it is an object of this invention to effect these advantages by providing a portable collapsible scaffold structure adapted to be supported in use and transported by a self-powered ground vehicle, the scaffold structure comprising extensible support means adapted to be mounted on the associated vehicle, two spaced-apart parallel extensible boom members releasably attachable to the support structure for support thereby in an inclined use configuration with the upper ends thereof being spaced a substantial distance horizontally away from the vehicle, drive means coupled to the extensible support means for effecting extension and retraction thereof to change the angle of inclination of the boom members with respect to the ground, a work platform extending in use between the boom members and removably pivotally secured thereto adjacent to the upper ends thereof, and control means coupled to the boom members and to the platform and operative when the angle of inclination of the boom members changes to effect a corresponding change in the angle between the boom members and the platform for maintaining the platform substantially horizontal, the support means and the boom members and the platform and the drive means and the control means all being dimensioned so that when disassembled from one another they may be readily stored on the associated vehicle for transportation thereby.

Further features of the invention pertain to the particular arrangement of the parts of the portable collapsible scaffold structure whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
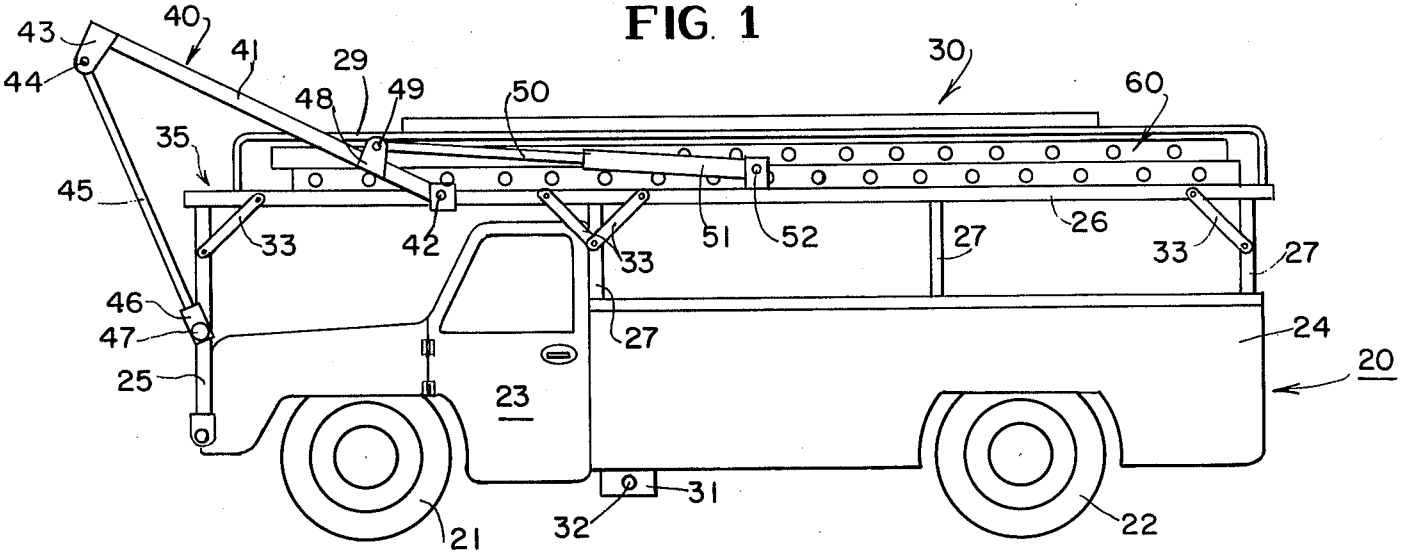
FIG. 1 is a side elevational view of a portable collapsible scaffold structure constructed in accordance with and embodying the features of the present invention, shown disassembled and mounted upon an associated truck for transportation thereby.

Referring now to FIG. 1 of the drawings, there is illustrated a portable collapsible scaffold structure, generally designated by the numeral 30, which is constructed in accordance with the present invention, and which is shown disassembled and stored on a truck, generally designated by the numeral 20. The truck 20 has front wheels 21 and rear wheels 22 supporting thereon a chassis including a cab 23 and a flat bed 24. Fixedly secured to the truck 20 is a framework 35, including two substantially parallel vertically-extending front frame uprights 25, respectively fixedly secured to the front end of the truck 20, as on the opposite ends of the front bumper. Fixedly secured to each side of the bed 24 and extending upwardly therefrom are three longitudinally spaced-apart, substantially parallel rear frame uprights 27. Interconnecting the front and rear uprights 25 and 27 along each side of the truck 20 are side rails 26 which may be interconnected by a plurality of transversely extending and longitudinally spaced-apart cross rails 28 (see FIGS. 3 and 3A). Corner braces 33 may be utilized to interconnect the side rails 26 and the uprights 25 and 27 to stiffen the frame construction. Fixedly secured to the side rails 26 and cross rails 28 and extending upwardly therefrom are retaining rails 29 which define a cage for retaining the portable collapsible scaffold structure 30 in place when it is stored on the truck 20. Respectively fixedly secured to the opposite sides of the truck bed 24 and depending therefrom immediately behind the cab 23 are two anchor blocks 31, each provided with an aperture 32 therein for a purpose to be described more fully below.

Respectively fixedly secured to the opposite sides of the framework 35 adjacent to the front end thereof are two upper extensible support structures, each generally designated by the numeral 40. The upper extensible support structures 40 are identical in construction, wherefore only one of them will be described in detail. Each of the support structures 40 includes an elongated arm 41 having one end thereof pivotally connected as at 42 to the adjacent one of the side rails 26, and being provided at the other end thereof with a bracket 43. Pivotally connected to the bracket 43 by a pivot pin 44 is one end of an elongated swing link 45, to the other end of which is affixed a pillow block 46 having an aperture 47 extending transversely therethrough. Fixedly secured to the arm 41 adjacent to the pivot connection 42 is a bracket 48 having pivotally connected thereto by a pivot pin 49 one end of a fluid-actuated piston rod 50, the other end of which is received in a cylinder 51 which is pivotally connected, as at 52, to the adjacent one of the side rails 26 rearwardly of the pivot connection 42. It will be appreciated that as the piston rod 50 is extended, the arm 41 is lowered, and as the piston rod 50 is retracted, the arm 41 is raised.

Figure 3:
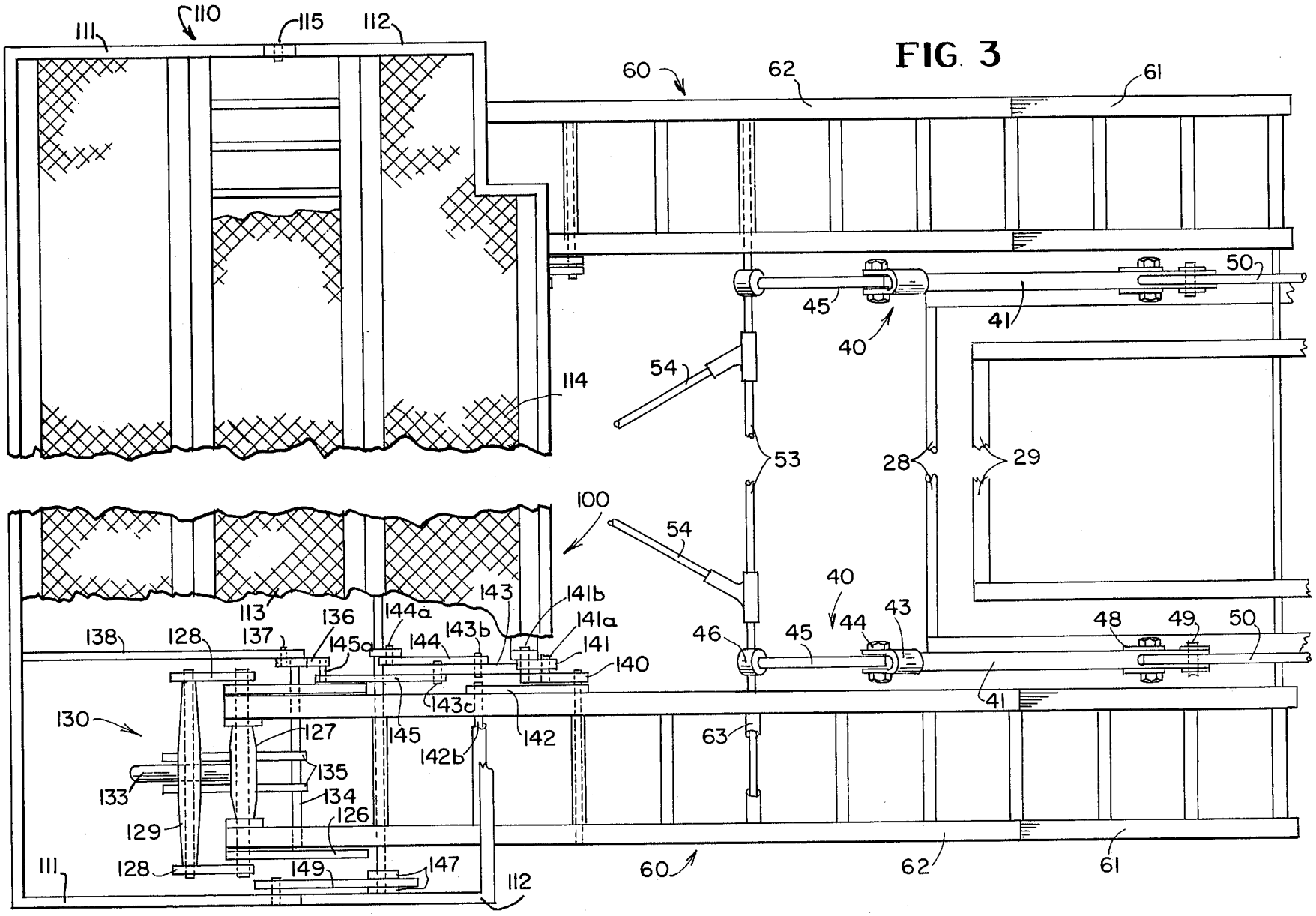
FIG. 3 is a fragmentary top plan view of the portion of the scaffold structure illustrated in FIG. 2, with parts thereof broken away more clearly to illustrate the structure.
Figure 5:
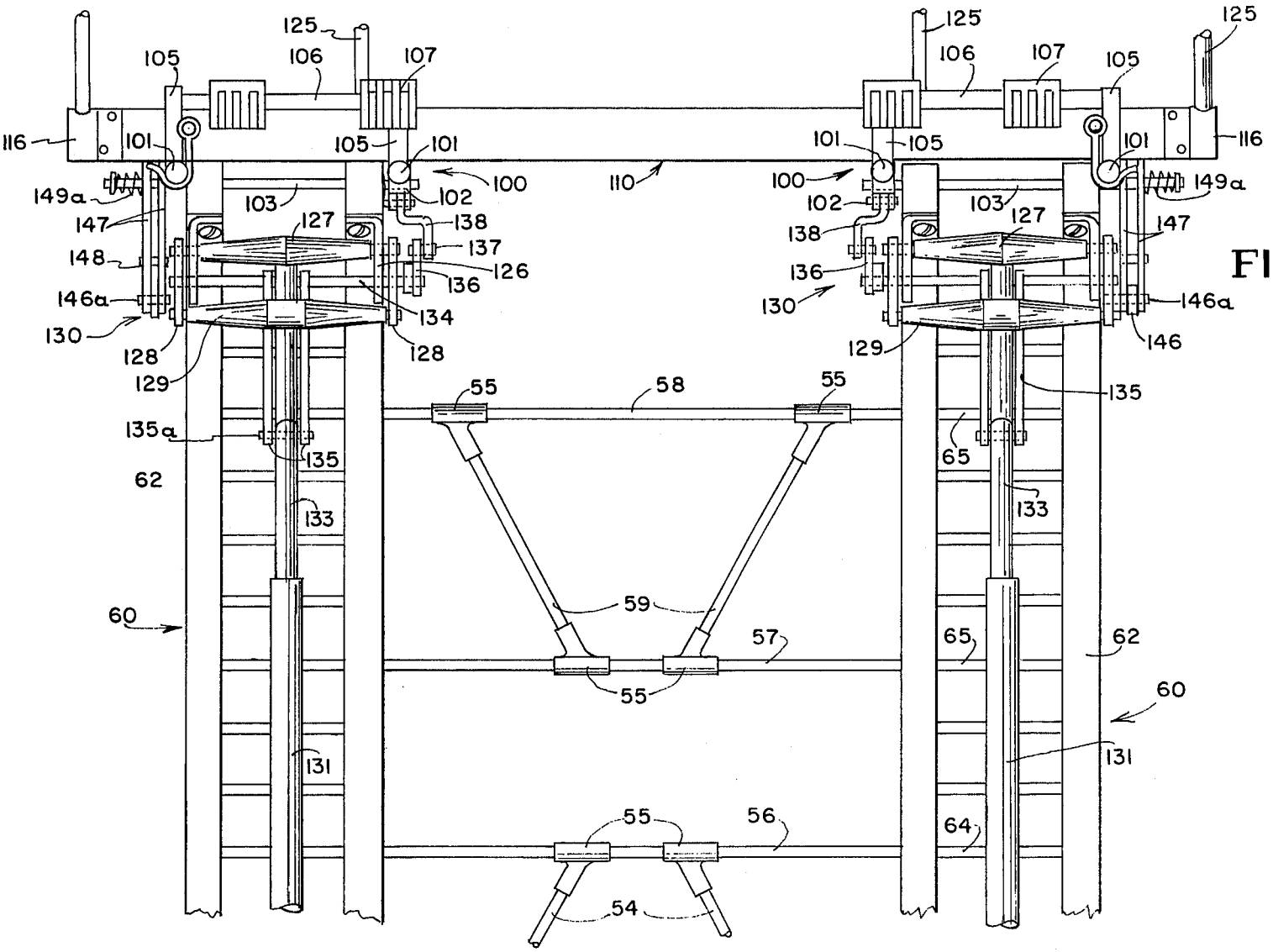
FIG. 5 is a fragmentary front elevational view (viewed from the left-hand side of FIG. 2) of the scaffold structure of the present invention, shown assembled for use.

Referring now also to FIGS. 3 and 5 of the drawings, received through the apertures 47 in the pillow blocks 46 is an elongated pivot brace bar 53, the opposite ends of which respectively extend outwardly a slight distance beyond the pillow blocks 46. Fixedly secured to the pivot brace bar 53 at spaced-apart points between the pillow blocks 46 are two coupling sleeves 55, to which are respectively coupled the ends of two diagonal struts 54, the other ends of which are coupled by similar sleeves 55 to a brace bar 56 disposed substantially parallel to the pivot brace bar 53 and substantially coterminous therewith. In like manner, two additional brace bars 57 and 58 are provided with sleeves 55 and are interconnected by a pair of struts 59.

Figure 2:
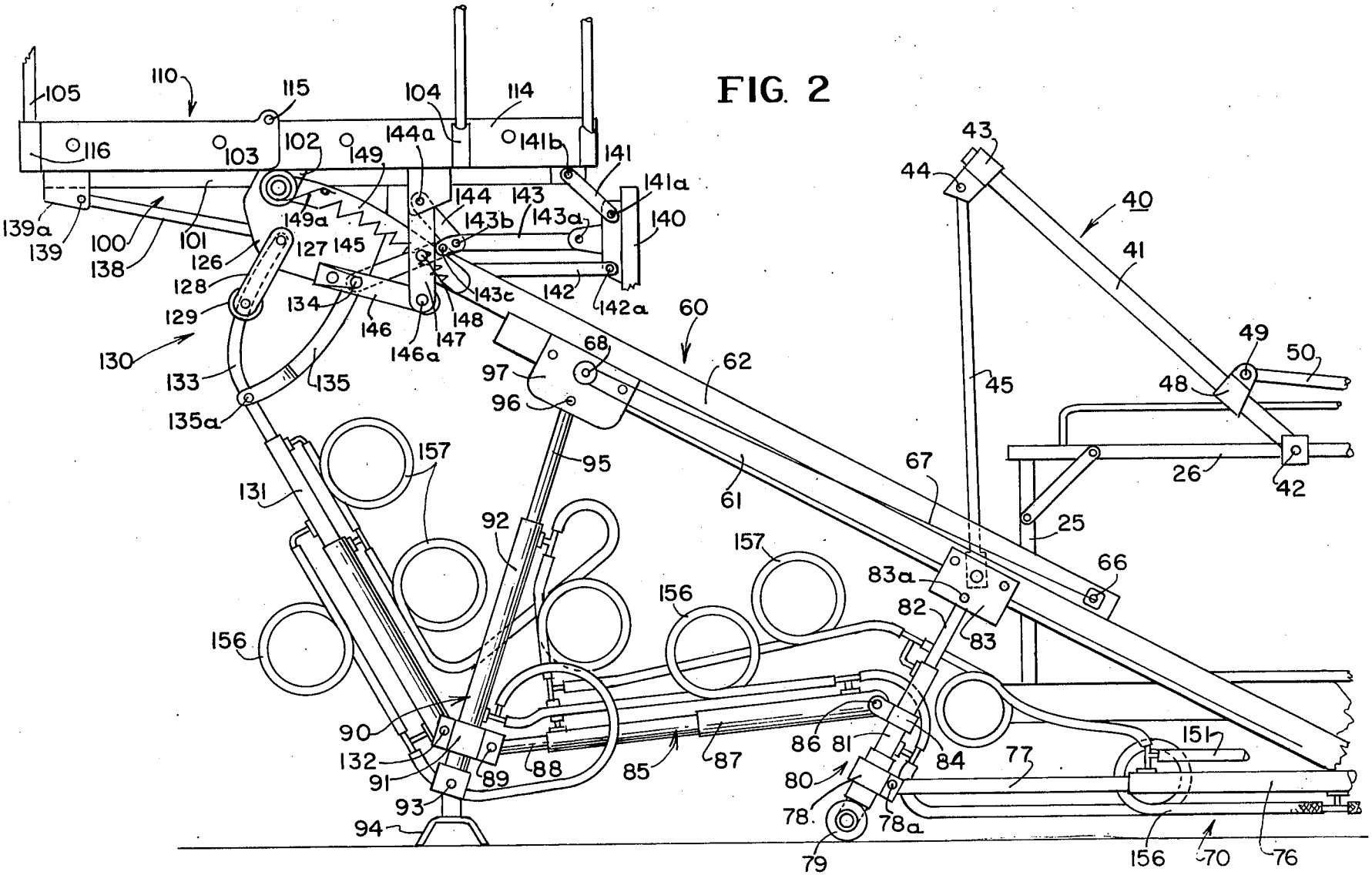
FIG. 2 is an enlarged fragmentary side elevational view of the front portion of the scaffold structure of the present invention, shown assembled for use.
Figure 2A:
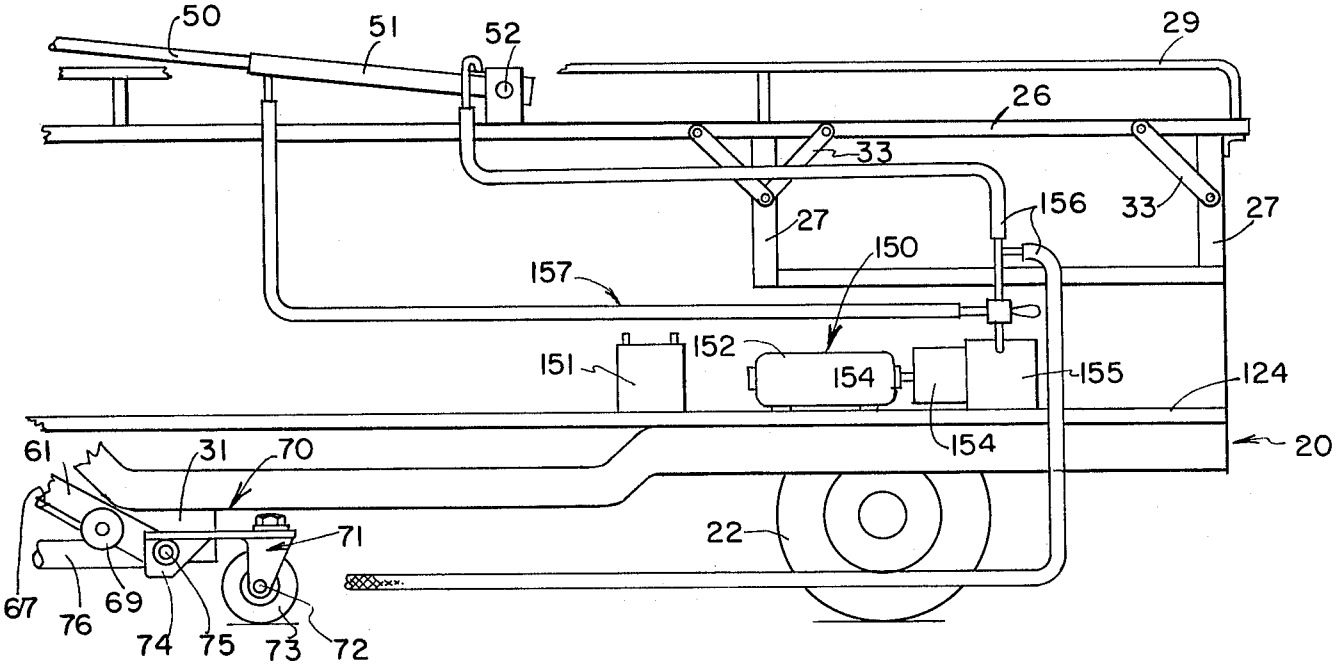
FIG. 2A is a fragmentary side elevational view of the rear portion of the scaffold structure of FIG. 2 shown assembled for use.

Referring now also to FIGS. 2 and 2A of the drawings, the scaffold structure 30 includes a pair of extension ladders, each generally designated by the numeral 60, and each including a lower ladder 61 and an upper ladder 62 disposed in overlapping sliding relationship with one another in standard fashion. The extension ladders 60 are respectively disposed in use along the opposite sides of the truck 20 extending forwardly therefrom. Preferably, each of the lower ladders 61 is provided along the inner side edge thereof with a pair of sockets 63 and 64 for respectively receiving therein the adjacent ends of the pivot brace bar 53 and the brace bar 56. In like manner, each of the upper ladders 62 is provided along the inner side edge thereof with a pair of sockets 65 for respectively receiving therein the adjacent ends of the brace bars 57 and 58. The sockets 63, 64 and 65 may include hollow rungs of the upper and lower ladders 61 and 62, as indicated in FIG. 3. It will be appreciated that any other suitable type of coupling means could be provided for coupling the extension ladders 60 to the brace bars 53 and 56–58. The pivot brace bar 53 is freely rotatable in the apertures 47 in the pillow blocks 46 so that the extension ladders 60 can pivot about the axis of the pivot brace bar 53, as will be described more fully below.

Each of the lower ladders 61 is provided along the outer side edge thereof adjacent to the forward end thereof with a cable pulley 68, around which is wrapped a cable 67, one end of which is fixedly secured to a cable anchor 66 at the rear end of the upper ladder 62, and the other end of which is secured to a cable spool 69 affixed to the rear end of the lower ladder 61 (see FIGS. 2 and 2A). The cable spool 69 may be manually operated or motor driven for extending and retracting the upper ladder 62 with respect to the lower ladder 61 in a well-known manner. It will be appreciated that, in use, the extension ladders 60 are adapted to be operated in tandem, the brace bars 53 and 56–58 serving to maintain a predetermined spaced-apart parallel and coplanar relationship between the extension ladders 60 at all times.

The rear or lower ends of the lower ladders 61 are respectively coupled to two carriages, each generally designated by the numeral 70, which are identically constructed. Each of the carriages 70 includes a bracket 71 provided with a transversely extending axle 72 on which is rotatably mounted a wheel 73 disposed for rolling engagement with the ground or other underlying support surface. The bracket 71 is also provided with a flange 74 to which the lower end of the adjacent one of the lower ladders 61 is pivotally connected by a pivot pin 75. Fixedly secured to the bracket 71 and projecting forwardly therefrom is a cylinder 76 privided with a fluid-actuated piston rod 77, the forward end of which is pivotally connected, as at 78*a*, to a front bracket 78 provided with a pair of front wheels 79, whereby the rear end of the associated extension ladder 60 is supported above the ground for rolling movement therealong. Fixedly secured to the front bracket 78 and projecting upwardly therefrom is a cylinder 81 provided with a fluid-actuated piston rod 82, the upper end of which is pivotally connected as at 83*a* to an attachment bracket 83 fixedly secured to the outer side of the associated lower ladder 61 intermediate the ends thereof.

Fixedly secured to the cylinder 81 intermediate the ends thereof is a coupling bracket 84 to which is connected an extensible coupling, generally designated by the numeral 85. The extensible coupling 85 includes a cylinder 87, one end of which is pivotally connected to the coupling bracket 84 by a pivot pin 86, the cylinder 87 being provided with a fluid-actuated piston rod 88, the distal end of which is pivotally connected by a pivot pin 89 to a bracket 91 of a front extensible support structure, generally designated by the numeral 90. The front extensible support structure 90 includes an upwardly extending cylinder 92 to the lower end of which the bracket 91 is fixedly secured, the lower end of the cylinder 92 also being pivotally coupled by a pivot pin 93 to a foot 94 which is adapted to rest upon the ground. The cylinder 92 is provided with a fluid-actuated piston rod 95, the upper end of which is pivotally coupled by a pivot pin 96 to a bracket 97 which is fixedly secured to the associated one of the lower ladders 61 adjacent to the forward or upper end thereof.

It will be appreciated that when the extension ladders 60 are to be raised, this is effected by retracting piston rods 50 and extending the piston rods 82 and 95. As the ladders 60 are elevated, the lower ends thereof may be moved forwardly by movement of the forward ends of the carriages 70, which is accommodated by retraction of the piston rods 88. It will be understood that in lowering the extension ladders 60, the reverse procedure is used. Also, if desired, the carriages 70 may be locked in position by engagement of pins thereof (not shown) respectively in the apertures 32 of the anchor blocks 31 on the truck 20. The wheeled carriages 70 also permit the scaffold structure 30 to be moved while erected by simply retracting the piston rods 50 enough to lift the feet 94 off the ground and then driving the truck 20 to the desired new location. For storage, the rear extensible support structures 80 and the front extensible support structures 90 may be folded back against the undersides of the associated extension ladders 60, this folding action being accommodated by retraction of the piston rods 77 and 88. Thus, the extension ladders 60 need not be disassembled from the associated extensible support structures 80 and 90 and may be stored therewith as a unit on the truck 20 in a folded or collapsed configuration. However, if desired, the extension ladders 60 may be completely disassembled from the extensible support structures 80 and 90 and from the carriages 70 and extensible couplings 85 by removal of the pivot pins 75, 78*a*, 83, 86, 89 and 96.

Figure 4:
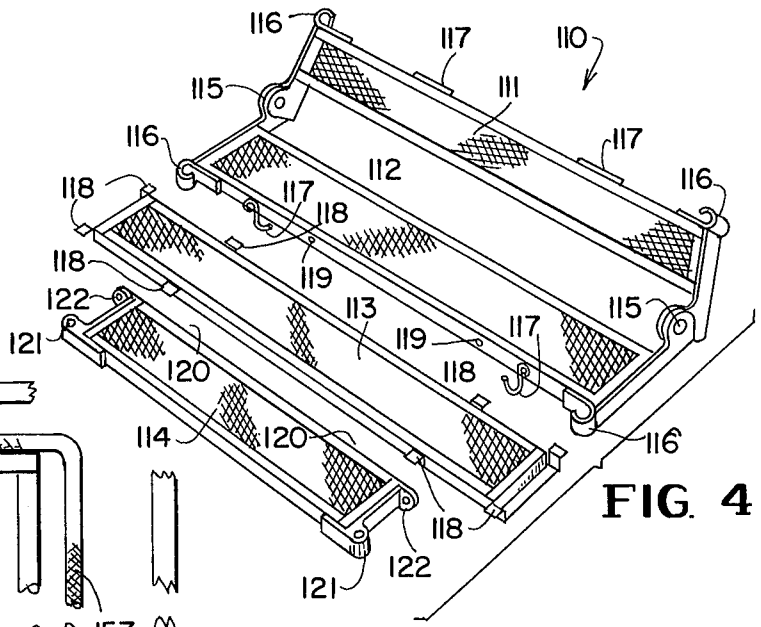
FIG. 4 is an exploded perspective view of the work platform of the present invention, shown disassembled.

Referring now also to FIG. 4 of the drawings, each of the extension ladders 60 is provided at the forward or upper end thereof with a platform support assembly, generally designated by the numeral 100. The platform support assemblies 100 are identically constructed, wherefore only one will be described in detail. Each of the platform support assemblies 100 includes a pair of laterally spaced-apart support bars 101 extending generally longitudinally of the associated extension ladders 60, each of the support bars 101 being provided midway between the ends thereof with a pivot bracket 102 for receiving therein one end of a pivot shaft 103 which interconnects the support bars 101 and pivotally couples them to the associated upper ladder 62. Each of the support bars 101 is provided at the rear end thereof with an upstanding retaining pin 104 and at the forward end thereof with an upstanding retaining pin 105, the pins 105 being interconnected by a bumper bar 106 carrying bumpers 107 thereon for a purpose to be described more fully below.

Referring now also to FIG. 4 of the drawings, a work platform, generally designated by the numeral 110, spans the platform support assemblies 101 and is supported thereon between the front and rear retaining pins 104 and 105. The platform 110 comprises four rectangular sections 111, 112, 113 and 114, the sections 111 through 113 being substantially the same size and shape and the section 114 being somewhat shorter. Preferably, each of the sections 111 through 114 comprises a metal peripheral frame surrounding and supporting a platform which may be formed of steel mesh decking or the like. The sections 111 and 112 are hingedly interconnected as at 115 so that, when disassembled, they may be folded one atop the other for compact storage. When unfolded for use they are disposed in substantially coplanar relationship and are spaced apart a predetermined distance by the hinge connections 115. The sections 111 and 112 are provided at the outer corners thereof with sockets 116 for a purpose to be described more fully below, with the outer longitudinal sides of the sections 111 and 112 each being provided with a pair of spaced-apart hooks 117.

The section 113 is provided with a plurality of support flanges extending laterally outwardly therefrom substantially coplanar with the upper surface thereof. In use, the section 113 is dimensioned and arranged to fit between the sections 111 and 112 and be supported thereon by the support flanges 118. The outer longitudinal edge of the section 112 is also provided with a pair of spacedapart holes or apertures 119 adapted to respectively receive therein pins 120 projecting from one longitudinal edge of the section 114 for attaching the section 114 to the section 112. The section 114 is additionally provided at the outer corners thereof with sockets 121 for a purpose to be described more fully below, and at the inner corners thereof with attachment tabs 122 which are received in use between the front edge of the section 113 and the retaining pins 104, further to secure the section 114 to section 112 in use.

When the sections 111 through 114 are thus assembled to form the platform 110, the platform 110 is mounted upon the support bars 101 with the section 114 being disposed rearwardly and between the inner rear retaining pins 104 of the two platform support assemblies 100, and with the sections 111 through 113 retained between the front and rear retaining pins 105 and 104. The hooks 117 are adapted to be hooked beneath the inner ones of the support bars 101 on each of the platform support assemblies 100, securely to hold the platform 110 in place on the platform support assemblies 100. It will be understood that the bumpers 107 are adapted to engage the side of a building or the like against which the scaffold structure 30 might be used. If desired, a railing assembly 125, partially illustrated in the drawings, may be provided around the side and rear edges of the platform 110 to protect workmen working thereon. The posts for such a railing assembly may be mounted in the sockets 116 and 121 and upon the rear pins 104 of the platfrom support assemblies 100. Any suitable railing construction may be utilized for this purpose. Access to the platform 110 is, of course, provided by the extension ladders 60.

Also respectively coupled to the platform support assemblies 100 are identically-constructed platform leveling mechanisms, each generally designated by the numeral 130. Each of the platform leveling mechanisms 130 includes a pair of mounting plates 126 respectively secured at the opposite sides of the upper end of the corresponding one of the upper ladders 62. Extending between the mounting plates 126 at the distal end thereof is a shaft 127. Respectively secured to the shaft 127 at the opposite ends thereof and extending downwardly therefrom are two brace arms 128 having a brace bar 129 extending therebetween. A fluid-actuated drive cylinder 131 is pivotally mounted by a pivot pin 132 to the bracket 91, the cylinder 131 being provided with a piston rod 133 which has a curved upper end extending through a complementary opening in the brace bar 129 and fixedly secured to the shaft 127 intermediate the ends thereof.

Also extending between the mounting plates 126 is a shaft 134 having fixedly secured thereto intermediate the ends thereof a pair of downwardly extending coupling arms 135, the lower ends of which are disposed on opposite sides of the piston rod 133 and are pivotally secured thereto by a pivot pin 135*a*. The inner end of the shaft 134 extends inwardly of the scaffold structure 30 beyond the adjacent mounting plate 126 and is fixedly secured to a bell crank lever 136, one end of which is pivotally secured by a pin 137 to a drive rod 138, which is in turn coupled by a pivot pin 139 to a bracket 139*a* Zat the forward end of the work platform 110.

In operation, as the scaffold structure 30 is raised, the work platform 110 starts out in a position substantially parallel to the extension ladders 60. As the extension ladders 60 are elevated, the piston rods 133 of the cylinders 131 are extended, thereby effecting, through the coupling arms 135, a clockwise rotation of the shafts 134 (as viewed in FIG. 2), thereby rotating the bell cranks 136. As the bell cranks 136 rotate, they pull the drive rods 138 rearwardly, thereby pulling the front end of the work platform 110 downwardly to increase the angle between the work platform 110 and the extension ladders 60 and maintain the work platform 110 in a substantially horizontal orientation as the extension ladders 60 are elevated. When the ladders 60 are lowered, the piston rods 133 are retracted, thereby rotating the shafts 134 in a counterclockwise direction as viewed in FIG. 2 and pushing the front end of the work platform 110 upwardly to keep it in a substantially horizontal orientation.

In order to provide additional support for the rear section 114 of the work platform 110, each of the platform support assemblies 130 includes a support bracket 140 having pivotally connected thereto at 141*a* one end of a link 141, the other end of which is pivotally connected at 141*b* to the rear section 114. Also pivotally connected at 142*a* to the support bracket 140 is one end of a link 142, the other end of which is pivotally connected at 142*b* to the associated upper ladder 62. Also pivotally connected to the support bracket 140 at 143*a* is the rear end of a forwardly extending arm 142, the other end of which is pivotally connected at 143*b* to one end of a link 144, the other end of which is pivotally connected at 144*a* to an attachment bracket on the work platform 110. Pivotally connected to the arm 143 at 143*c* is one end of a link 145, the other end of which is provided with an elongated slot (not shown) in which is received a pin 145*a* connected to the rear end of the bell crank 136 (see FIG. 3). Thus, the support bracket 140 and the arm 143 are coupled to the work platform 110 by the links 141 and 144 and are coupled by the link 142 to the upper ladder 62 and by the link 145 and bell crank 136 to the shaft 134, for supporting the rear section 114 of the work platform 110 on the upper ladder 62 and the shaft 134.

In operation, as the ladders 60 are elevated and the forward end of the work platform 110 is pivoted downwardly through the action of the bell cranks 136 in the manner described above, the support brackets 140 and associated linkages move via the links 145 and pins 145*a* to follow the tilting motion of the work platform 110, whereby the rear section 114 may be firmly supported while the angle of the work platform 110 is changing with respect to the extension ladders 60. The additional support provided by the support brackets 140 and associated linkages is necessary to insure against disengagement of the rear section 114 from the work platform 110 when, for example, a workman is standing on the rear section 114.

When the extension ladders 60 are elevated and the workmen are operating upon the work platform 110, the platform 110 is prevented from tipping forwardly as workmen walk along the forward edge thereof by reason of the piston rods 133 which are supported by the pressure in the cylinders 131. In order to prevent the work platform 110 from tipping rearwardly in use, there is provided at each end thereof a latch mechanism, the latch mechanisms being identical in construction, whereby only one will be described in detail.

Referring in particular to FIG. 2 of the drawings, each latch mechanism includes a support arm 146 which is pivotally connected to the outer end of the shaft 134, the arm 146 extending rearwardly to a distal end which is received between a pair of upwardly extending arms 147, and is pivotally coupled thereto by a pin 146*a*. The upper ends of the arms 147 are pivotally coupled to the pivot pin 144*a* on the work platform 110. Extending between the arms 147 intermediate the ends thereof is a pin 148. The spaced-apart arms 147 define a slot in which is received a ratchet arm 149 overlying the pin 148 and having a plurality of ratchet teeth engageable therewith, the ratchet arm 149 being pivotally connected to the shaft 103. Also anchored on the shaft 103 is a torsion spring 149*a* which is disposed in engagement with the upper end of the ratchet arm 149 for resiliently urging it downwardly into engagement with the pin 148.

The ratchet teeth are so arranged as to permit counterclockwise rotation of the work platform 110 about the axis of the shaft 103 (as viewed in FIG. 2), but to prevent clockwise rotation thereof. Thus, the latch mechanism permits the downward tilting of the front end of the work platform 110 during the raising of the scaffold structure 30, but prevents such tipping movement when the scaffold structure 30 is stationary. When the extension ladders 60 are to be lowered, the necessary clockwise rotation of the work platform 110 is accommodated by reason of the pivotal connections of the arms 146 and 147, whereby as the rear end of the work platform 110 tends to move downwardly, the ratchet pins 148 move downwardly with it, so that relative ratcheting movement of the ratchet arms 149 with respect to the pins 148 is not necessary.

It will be understood that the platform leveling mechanism 130 described above is provided in connection with each of the extension ladders 60, so that there are two identically constructed platform leveling mechanisms 130 respectively provided at the opposite ends of the work platform 110. By reason of these mechanisms 130, it is possible to maintain the work platform 110 in a substantially horizontal position as the scaffold structure 30 is erected and lowered, while at the same time providing firm support for the entire work platform 110, including the rear section 114 thereof, and while the latch mechanisms effectively lock the work platform 110 against pivotal movement with respect to the extension ladder 60 when the scaffold structure 30 has been erected.

Figure 3A:
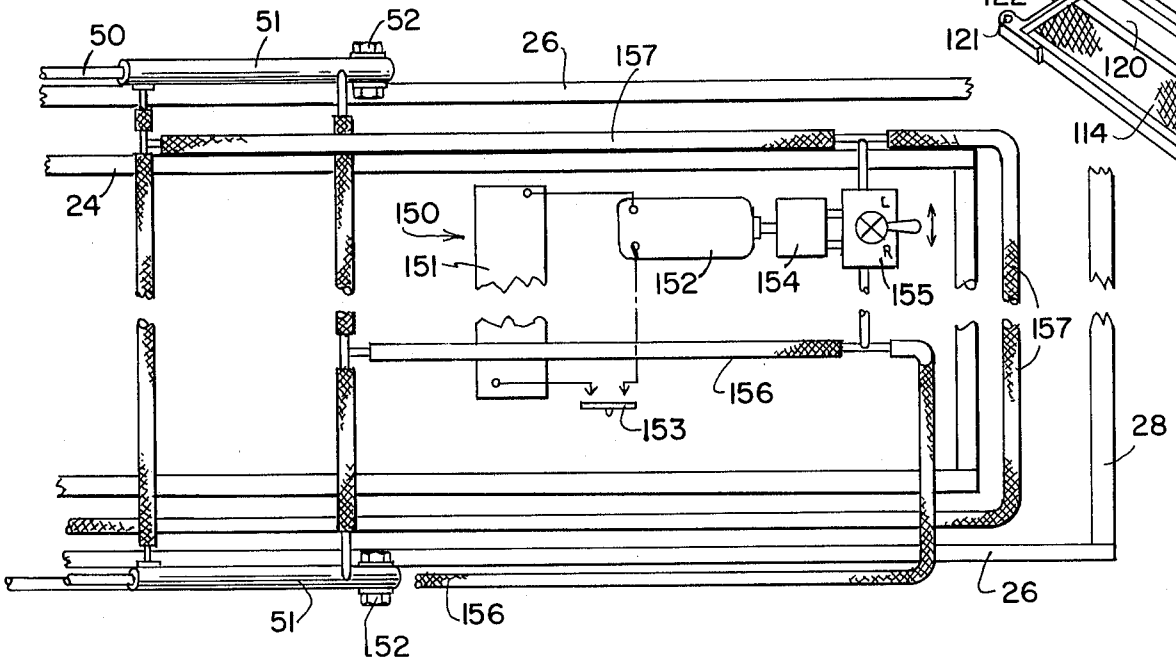
FIG. 3A is a top plan view of the portion of the scaffold structure of the present invention illustrated in FIG. 2A.

Referring now to FIGS. 2, 2A and 3A of the drawings, the cylinders 51, 76, 81, 87, 92 and 131 are all preferably hydraulically operated, for which purpose there is provided a hydraulic system, generally designated by the numeral 150, mounted upon the truck bed 24. The hydraulic system includes an electric storage battery 151 which is connected through a switch 153 to an electric motor 152 which drives a pump 154. The pump 154 is coupled to a fluid control valve 155 having "Lower" and "Raise" conditions, respectively designated by letters "L" and "R" in FIG. 3A of the drawings. The control valve 155 is coupled to a conduit network including a "Raise" conduit 156 and a "Lower" conduit 157, the "Raise" conduit 156 being connected in parallel to the lower ends of each of the cylinders 51, 76, 81, 87, 92 and 131, and the "Lower" conduit 157 being connected in parallel to the upper ends of each of those cylinders, for extension and retraction of the piston rods in a well-known manner. As is indicated in FIG. 2, the sections of the conduits 156 and 157 extending between adjacent ones of the cylinders have sufficient length to accommodate full extension and retraction of the associated piston rods. It will be appreciated that a pneumatic system could be utilized in lieu of the hydraulic system 150.

The assembly and operation of the portable collapsible scaffold structure 30 will now be described in detail. If the carriages 70, extensible support structures 80 and 90 and extensible couplings 85 are stored on the truck 20 separately from the extension ladders 60, the first step is reassembly of these components and placement of the extension ladders 60 respectively along the opposite sides of the truck 20. The pivot brace bar 53 may be permanently coupled to the pillow blocks 46, but if not, it is at this time assembled thereto. Also, the struts 54, sleeves 55 and the brace bar 56 may all be preassembled to the pivot brace bar 53, but if not, they are now assembled to the configuration illustrated in the drawings. In like manner, the brace bars 57 and 58 are assembled together with the struts 59. Then, adjacent ends of the brace bars 53 and 56–58 are inserted in the corresponding sockets in one of the extension ladders 60. Then the other of the extension ladders 60 is assembled to the brace bars 53 and 56–58. Next, the platform 110 is assembled and mounted in place on the platform support assemblies 100.

When the parts of the scaffold structure 30 have been thus assembled, the structure is erected by operation of the hydraulic system 150. Initially, the cylinders 76, 81, 87, 92 and 131 are folded flat against the bottoms of the ladders 60. Preferably, all of these cylinders are operated substantially simultaneously with the cylinders 51 to unfold the former cylinders as the ladders 60 are elevated. Thus, the piston rods 77 and 88 are extended to unfold the rear and front extensible support structures 80 and 90. The extension of the piston rods 95 and 133 is preferably such that the feet 94 remain off the ground until the scaffold structure 30 has been elevated to the desired height, at which time the feet 94 are lowered to firmly support the scaffold structure 30 on the ground. By this procedure, the truck 20 can be moved if necessary during the erection process to achieve the desired positioning of the work platform 110. As the extension ladders 60 are elevated to the desired angle of inclination, the upper ladders 62 are extended with respect to the lower ladders 61 by means of the cables 67, as necessary, to reach the desired height. The carriages 70 may move along the ground to bring the platform 110 into the desired operating position, for example, with the bumpers 107 in contact with the side of a building or the like, this movement being accommodated by retraction of the piston rods 88.

It will be appreciated that the platform leveling mechanisms 130 serve to maintain the platform 110 in a substantially level, horizontal position during raising and lowering of the extension ladders 60. It will also be appreciated that, if desired, a control valve for the hydraulic system 150 could be mounted on the platform 110 so that the workmen thereon could adjust the position of the platform 110 without having to descend therefrom. It will further be understood that each of the cylinders 51, 76, 81, 87, 92 and 131 is preferably provided with its owr control valve so that each of these cylinders can be independently controlled.

It is a significant advantage of the present invention that the portable collapsible scaffold structure 30 is supported in use upon the ground adjacent to the truck 20, so that it may be positioned forwardly of the truck 20, and it is not necessary for the truck 20 to be able to drive immediately beneath or closely alongside the work area. Thus, the present invention is uniquely suitable for work along walls or the sides of buildings or the like for painting, siding, brickwork, carpentry, roofing, or the like which normally requires the use of scaffolding.

When the work is finished, the scaffold structure 30 can be collapsed and, if desired, disassembled so that it can be stored in a very compact space on the truck 20. The erection and disassembly of the scaffold structure 30 is readily accomplished and can easily be done by one man in less than half an hour. It will be understood that, while the scaffold structure 30 has been disclosed as mountable adjacent to the front end of the truck 20, the apparatus could as well be set up for erection at the rear end of the truck 20 by appropriate modification of the placement of the upper extensible support structures 40.

From the foregoing, it can be seen that there has been provided an improved portable collapsible scaffold structure which can be collapsed and disassembled for storage in a compact area on a vehicle and which can be simply and easily assembled and erected for use.

There has also been provided an improved scaffold structure of the character described, which permits an elongated work platform to be automatically raised or lowered and positioned at a work site, the scaffold structure being disposed for use adjacent to but not immediately above the associated vehicle, so that it is not necessary to drive the vehicle beneath or immediately alongside the work site.

There has also been provided a scaffold structure of the character described, which is fully and automatically adjustable, and wherein the work platform may be maintained level during raising and lowering of the scaffold structure.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A portable collapsible scaffold structure adapted to be supported in use and transported by a self-powered ground vehicle, said scaffold structure comprising extensible support means adapted to be mounted on the associated vehicle, two spaced-apart parallel extensible boom members releasably attachable to said support structure for support thereby in an inclined use configuration with the upper ends thereof being spaced a substantial distance horizontally away from the vehicle, drive means coupled to said extensible support means for effecting extension and retraction thereof to change the angle of inclination of said boom members with respect to the ground, a work platform extending in use between said boom members and removably pivotally secured thereto adjacent to the upper ends thereof, and control means coupled to said boom members and to said platform and operative when the angle of inclination of said boom members changes to effect a corresponding change in the angle between said boom members and said platform for maintaining said platform substantially horizontal, said support means and said boom members and said platform and said drive means and said control means all being dimensioned so that when disassembled from one another they may be readily stored on the associated vehicle for transportation thereby.

2. The scaffold structure set forth in claim 1, wherein each of said boom members comprises an extension ladder.

3. The scaffold structure set forth in claim 1, wherein said work platform comprises a plurality of interconnected members collapsible to a compact configuration to facilitate transportation thereof on the associated vehicle.

4. The scaffold structure set forth in claim 1, wherein said control means includes mechanical linkage interconnecting said boom members and said platform for controlling the relative movement thereof.

5. The scaffold structure set forth in claim 1, wherein said drive means comprises fluid-actuated piston and cylinder means.

6. The scaffold structure set forth in claim 1, and further including means rigidly interconnecting said boom members at longitudinally spaced-apart points therealong so that said boom members will move in unison.

7. A portable collapsible scaffold structure adapted to be supported in use and transported by a self-powered ground vehicle, said scaffold structure comprising first extensible support means adapted to be mounted on the associated vehicle, two spaced-apart parallel extensible boom members releasably attachable to said support means for support thereby in an inclined use configuration with the upper ends thereof being spaced a substantial distance horizontally away from the vehicle, second extensible support means adapted to be supported on the ground and pivotally secured at the upper end thereof to said boom members outboard of said first support means, drive means coupled to said first and second means for extension and retraction thereof to change the angle of inclination of said boom members with respect to the ground, a work platform extending in use between said boom members and removably pivotally secured thereto adjacent to the upper ends thereof, and control means coupled to said boom members and to said platform and operative when the angle of inclination of said boom members changes to effect a corresponding change in the angle between said boom members and said platform for maintaining said platform substantially horizontal, said support means and said boom members and said platform and said drive means and said control means all being dimensioned so that when disassembled from one another they may be readily stored on the associated vehicle for transportation thereby.

8. The scaffold structure set forth in claim 7, wherein said first extensible support means comprises fluid-actuated piston and cylinder means for lifting said boom members from thereabove, said second extensible support means comprising fluid-actuated piston and cylinder means for pushing said boom members from therebelow, said drive means comprising a fluid drive system.

9. The scaffold structure set forth in claim 7, wherein said control means includes extensible strut means interconnecting said second extensible support means and the coupling between said platform and the upper ends of said boom members, said drive means being coupled to said extensible strut means for effecting extension and retraction thereof to effect change in the angle between said boom members and said platform.

10. The scaffold structure set forth in claim 7, wherein said extensible support means includes two extensible support members respectively pivotally secured to said boom members.

11. The scaffold structure set forth in claim 7, wherein said second extensible support means includes a foot member for resting upon the ground, and an elongated support post pivotally coupled to said foot and pivotally coupled to said boom members.

12. A portable collapsible scaffold structure adapted to be supported in use and transported by a self-powered ground vehicle, said scaffold structure comprising first extensible support means adapted to be mounted on the associated vehicle, two spaced-apart parallel extensible boom members releasably attachable to said support structure for support thereby in an inclined use configuration with the upper ends thereof being spaced a substantial distance horizontally away from the vehicle, second extensible support means adapted to be supported on the ground and pivotally secured at the upper end thereof to said boom members outboard of said first support means, extensible coupling means connected between said second support means and the lower ends of said boom members, drive means coupled to said first and second support means and to said coupling means for extension and retraction thereof to change the angle of inclination of said boom members with respect to the ground and to effect corresponding variations in the spacing between said second support means and the lower ends of said boom members, a work platform extending in use between said boom members and removably pivotally secured thereto adjacent to the upper ends thereof, and control means coupled to said boom members and to said platform and operative when the angle of inclination of said boom members changes to effect a corresponding change in the angle between said boom members and said platform for maintaining said plaftform substantially horizontal, said support means and said boom members and said coupling means and said platform and said drive means and said control means all being dimensioned so that when disassembled from one another they may be readily stored on the associated vehicle for transportation thereby.

13. The scaffold structure set forth in claim 12, wherein said extensible coupling means comprises a fluid-actuated cylinder and piston, said drive means comprising a fluid drive system.

14. The scaffold structure set forth in claim 12, wherein said second extensible support means includes two extensible support members respectively pivotally secured to said boom members, said extensible coupling means comprising two extensible coupling members, each of said extensible coupling members being coupled between one of said support members and the corresponding one of said boom members.

15. A portable collapsible scaffold structure adapted to be supported in use and transported by a self-powered ground vehicle, said scaffold structure comprising first extensible support means adapted to be mounted on the associated vehicle, two spaced-apart parallel extensible boom members releasably attachable to said support structure for support thereby in an inclined use configuration with the upper ends thereof being spaced a substantial distance horizontally away from the vehicle, second extensible support means adapted to be supported on the ground and pivotally secured at the upper end thereof to said boom members outboard of said first support means, carriage means disposed in rolling engagement with the ground and releasably pivotally coupled to the lower end of each of said boom members and extending forwardly therefrom, third extensible support means interconnecting the forward end of said carriage means and points on said boom members intermediate the lower ends thereof and the points of connection thereto of said second support means, extensible coupling means interconnecting said second and third support means, drive means coupled to said first and second and third extensible support means and to said extensible carriage means and to said extensible coupling means for effecting extension and retraction thereof to change the angle of inclination of said boom members with respect to the ground, the extension and retraction of said coupling means serving to effect movement of the lower ends of said boom members toward and away from the lower end of said second support means to facilitate positioning of said boom members, the extension and retraction of said carriage means and said coupling means serving to facilitate folding of said second and third support means against said boom members for storage and transportation thereof, a work platform extending in use between said boom members and removably pivotally secured thereto adjacent to the upper ends thereof, and control means coupled to said boom members and to said platform and operative when the angle of inclination of said boom members changes to effect a corresponding change in the angle between said boom members and said platform for maintaining said platform substantially horizontal, said support means and said boom members and said carriage means and said coupling means and said platform and said drive means and said control means all being dimensioned so that when disassembled from one another they may be readily stored on the associated vehicle for transportation thereby.

16. The scaffold structure set forth in claim 15, wherein said carriage means is elongated and is provided with two wheel assemblies respectively disposed at the opposite ends thereof.

17. The scaffold structure set forth in claim 15, wherein said carriage means is elongated and is provided with two wheel assemblies respectively disposed at the opposite ends thereof, and further including extensible coupling means interconnecting said two wheel assemblies for providing longitudinal extension and retraction of said carriage means.

18. The scaffold structure set forth in claim 15, wherein said carriage means includes two carriage assemblies respectively coupled to said two boom members.

19. The scaffold structure set forth in claim 15, wherein said second extensible support means includes two extensible support members respectively pivotally secured to said boom members, said carriage means comprising two carriage assemblies respectively coupled to said two boom members, said third extensible support means includes two third extensible support members respectively connecting said carriage assemblies to the corresponding one of said boom members, and said extensible coupling means includes two extensible coupling members respectively coupling said carriage assemblies to the corresponding ones of said second extensible support members.

20. The scaffold structure set forth in claim 15, wherein each of said first and second and third extensible support means and said extensible coupling means comprises fluid-actuated piston and cylinder means, said drive means comprising a fluid drive system.

* * * * *